United States Patent [19]

Herrig et al.

[11] 4,188,020

[45] Feb. 12, 1980

[54] KNOTTED WIRE FENCING

[75] Inventors: Klaus Herrig; Heinz Wagner, both of St. Ingbert, Fed. Rep. of Germany

[73] Assignee: Acieries Reunies de Burbach-Eich-Dudelange S.A. ARBED, Luxembourg, Luxembourg

[21] Appl. No.: 848,325

[22] Filed: Nov. 3, 1977

[30] Foreign Application Priority Data

Nov. 4, 1976 [DE] Fed. Rep. of Germany ..... 2650578

[51] Int. Cl.[2] ..... E04H 17/04

[52] U.S. Cl. ..... 256/45; 245/8

[58] Field of Search ..... 256/32, 33, 34, 73, 256/45; 140/7; 245/1, 2, 11, 8

[56] References Cited

U.S. PATENT DOCUMENTS

| | | | |
|---|---|---|---|
| 526,368 | 9/1894 | Barling | 245/8 |
| 576,069 | 1/1897 | Perry | 245/2 |
| 614,300 | 11/1898 | Gleason | 245/11 |
| 834,867 | 10/1906 | Biesemeier | 256/32 |
| 845,072 | 2/1907 | Fisher | 256/11 |
| 1,012,347 | 12/1911 | Fredrick | 245/8 |
| 1,063,223 | 6/1913 | Sommer | 245/8 |

*Primary Examiner*—Werner H. Schroeder
*Attorney, Agent, or Firm*—Karl F. Ross

[57] ABSTRACT

Knotted wire fencing, e.g. for enclosing a cultivated or uncultivated region which may be traversed by animals or other creatures of various sizes, comprises longitudinal (horizontal) and transverse (vertical) wires forming a mesh and tied together at the junctions or intersections of the two arrays of wires. The length of the transverse (vertical) wires periodically changes along the fencing relative to the maximum breadth thereof so that some wires extend the full breadth (height) of the fence while others extend from the bottom thereof only partly over the height of the fencing. The shorter transverse wires have a length which differs from that of the full-length transverse (vertical) wires by the height of one mesh.

1 Claim, 3 Drawing Figures

KNOTTED WIRE FENCING

FIELD OF THE INVENTION

The present invention relates to a so-called knotted wire mesh, and, especially, knotted wire fencing of the type in which two arrays of wires, namely, longitudinal and transverse wires, are tied together at the crossover points of the two arrays and form a fence adapted to be used for enclosing cultivated or uncultivated regions which may be traversed by creatures of various sizes. At each crossover point, the transverse wires and the longitudinal wires are interconnected to limit relative mobility by any of a variety of tying or knotting arrangements.

BACKGROUND OF THE INVENTION

Wire mesh of the type described can be used for fencing uncultivated or cultivated regions which may be traversed by animals or other creatures of different sizes, the wire mesh being erected in an upright manner so that the longitudinal wires extend more or less horizontally while the transverse wires extend vertically.

The parallel arrays of wires define a mesh which has a certain height and a certain width, the height being measured in the vertical direction, e.g. between successive longitudinal wires while the width is measured horizontally, e.g. as the distance between successive transverse wires.

It is known in fencing of this type to progressively or in a stepwise manner increase the spacing of the longitudinal wires from one another upwardly from the bottom of the fence to the top thereof, the transverse wire spacing being maintained substantially constant.

This configuration of the knotted-wire mesh fence has numerous advantages. For example, it may prevent the passage of smaller animals or other creatures which tend to move along the ground and seldom are capable of penetrating through even relatively large openings at upper locations of a fence. In addition, since the larger animals do not penetrate the fence, even through the larger openings afforded by the greater spacing of the longitudinal wires at the upper portion of the fence, a relatively high fence can be made with a smaller number of longitudinal wires than is the case with conventional fencing having a constant mesh height and width and thus equal spacing of both the longitudinal and the transverse wires.

The crossover points between the wires may be interconnected by various tying means although in common practice, the junction is formed by twisting one of the wires around the other, usually, the transverse wires around the longitudinal wires, the longitudinal wires being provided with slight undulations in the region of the crossover point to prevent shifting of the knot along the longitudinal wires.

Depending upon the use to which the mesh is to be put and its construction, commercial knotted mesh fencing can have a spacing of the longitudinal wires which ranges between 3 and 20 cm while the spacing between the transverse wires is 15 to 30 cm.

With such dimensions, the number of longitudinal wires determines the width of the mesh which is usually between 0.65 and 2.00 meters. The mesh can be coiled in lengths of 50 to 100 meters and the twist-type junctions at the crossover points are customarily made so that a hinge-like connection is provided to permit swiveling of one wire in the twisted portion of the other.

The wire diameter for both the longitudinal and transverse wires as well as for the wires provided at the edge of the mesh can be the same or different and usually is between 1.5 and 4 mm. The wires can be coated with synthetic resin material.

When the aforedescribed knotted-mesh fencing is used to enclose an area from which smaller animals or creatures are to be excluded, or to be prevented from escaping, the conventional fencing has upper mesh widths which are excessively small considering the fact that neither access to smaller creatures is afforded nor can the larger creatures pass through the fencing.

In other words, conventional fencing of the type described is not actually made in the most effective and efficient manner to fence in or out creatures of various heights for a given amount of material.

OBJECT OF THE INVENTION

It is the principal object of the invention to provide knotted-mesh fencing whereby the aforedescribed disadvantages are obviated and which has a minimum weight or material usage for normal enclosure purposes.

It is another object of this invention to improve upon knotted-mesh fencing so that the latter has a better relationship to the size relationship of the creatures to be fenced in or out by the mesh.

Still another object of the invention is to provide an improved all-purpose fencing for fencing cultivated or uncultivated regions.

SUMMARY OF THE INVENTION

These objects are attained, in accordance with the present invention, in a knotted wire mesh fencing which comprises the longitudinal wires and the transverse wires, tied together at their crossover points, with the height of the meshes increasing from the bottom edge of the wire mesh (when the latter is used as a fence) to the opposite edge thereof, whereby, in addition, the transverse wire lengths periodically alter over the length of the wire mesh with respect to the maximum transverse wire length corresponding to the full width of the mesh by an amount which is at least equal to one mesh height, i.e. the distance between longitudinal wires in the region of this other mesh.

According to the invention, each second transverse wire or each second and third transverse wires are made shorter than the first transverse wire, and the next non-foreshortened transverse wire, by a distance equal to one mesh height. Each mesh opening at the upper edge of the fencing, corresponding to the aforementioned other edge of the mesh, thus has an opening of a width (measured between transverse wires) which is equal to 2, 3, or 4 times the transverse wire spacing at lower portions of the fence.

At the top of the fence, therefore, each second and third, or each second, third or fourth mesh transverse wire is omitted from the normal mesh sequence.

BRIEF DESCRIPTION OF THE DRAWING

The above and other object, features and advantages of the present invention will become more readily apparent from the following description, reference being made to the accompanying drawing in which.

SPECIFIC DESCRIPTION

Figure 1:
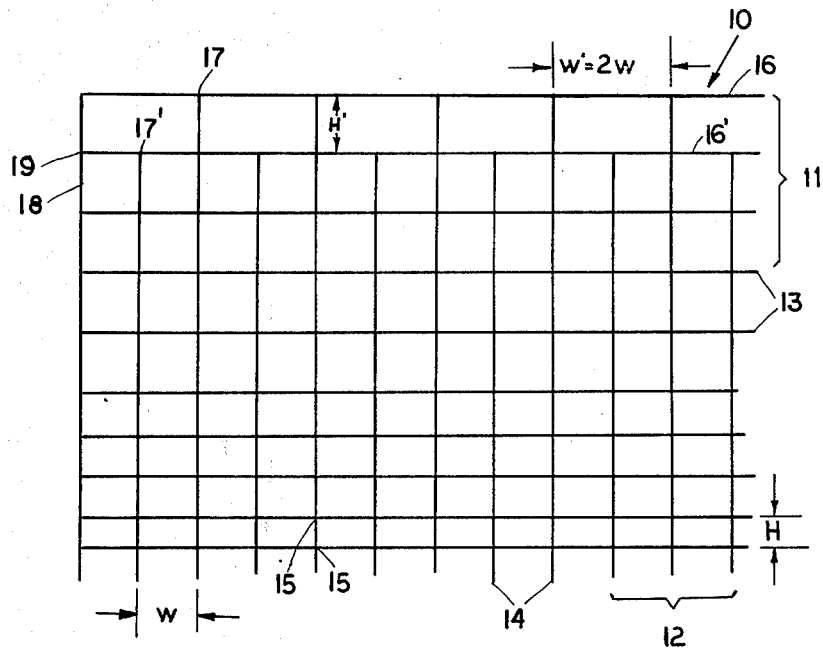
FIG. 1 illustrates an embodiment of a knotted-mesh fencing according to the invention.

FIG. 1 shows a knotted wire mesh fencing somewhat diagrammatically, the fencing 10 comprising an array 11 of longitudinal (horizontal) wires in vertically spaced relation, the spacing increasing progressively from the height H to the mesh height H'.

The array 11 of longitudinal wires 13 has crossover points 15 with an array 12 of transverse (vertical) wires 14 which at the lower portion of the fence have a constant spacing W.

At the end wire 18 of the fence, which can be of a larger diameter, the longitudinal wires 13 can be twisted around the transverse wire 18 at tiepoints 19. Similarly, those transverse wires 14 which reach the uppermost longitudinal wires 16 can be twisted around them at the tiepoint 17. In addition to the transverse wires which run the full height of the fence and hence the full width of the mesh, alternate transverse wires 14 terminate one mesh height H' short of the top of the fence corresponding to a edge of the mesh. These wires are connected to the underlying wire 16' at tiepoints 17'.

In this embodiment, if the mesh size just below the wire 16' is 15×15 cm, it can be 15×30 cm between the wires 16 and 16'.

Figure 2:
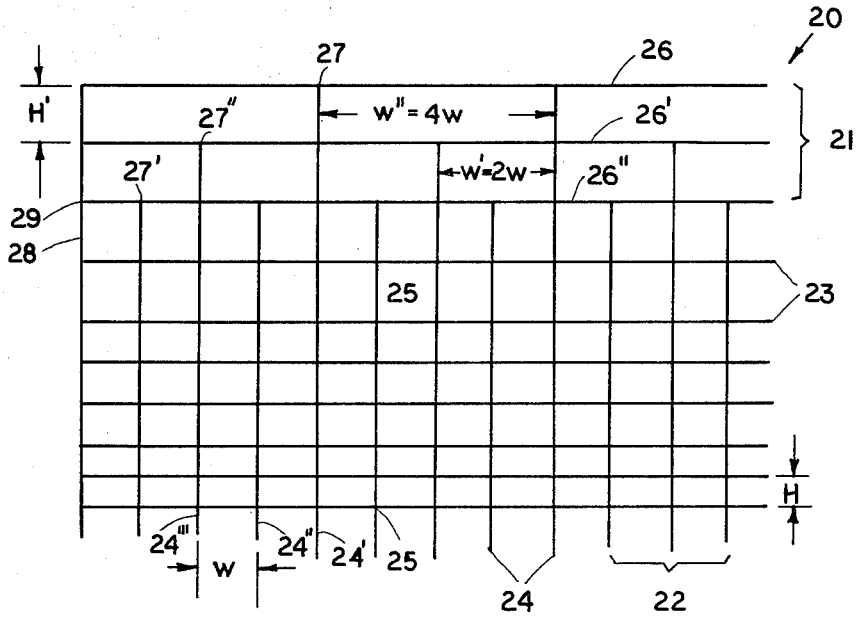
FIG. 2 illustrates another embodiment thereof.

In the embodiment of FIG. 2, the mesh or fence 20 is formed by an array 21 of longitudinal wires 23 and an array 22 of transverse wires 24, the two arrays being interconnected at the crossover points 25 in the manner previously described. Here again, the mesh height increases from H at the bottom of the fence to H' at the top of the fence while the mesh width W along the bottom of the fence remains constant. The terminal wire 28 can be connected to all of the longitudinal wires 23 at the tiepoints 29. The long transverse wires 24' are tied directly to the uppermost wire 26 of the longitudinal array at tiepoints 27. The next wire 24'', which is shorter than the wire 24' by two mesh heights (2H') is tied at 27' to the third longitudinal wire from the top which has been represented at 26''. Between two such transverse wires 24'', there is provided a transverse wire 24''' of intermediate height which is tied to the wire 26' between the wires 26 and 26'' at the tiepoint 27''.

Thus, between the upper wire 26 and the next lower wire 26', the mesh can have a width W'' of 4W or 60 cm while the height H' is 15 cm. Between the longitudinnal wires 26' and 26'', however, the meshes have a width W' equals 2W or 30 cm and a height H' of 15 cm.

Naturally, other patterns of foreshortening of the transverse wires can also be used.

While the arrangements shown in FIGS. 1 and 2 have been found to be suitable for most purposes without increasing the diameters of the upper wires, if greater resistance to deformation or strength is required in the regions where wider meshes are provided, wires of larger diameter can be used or reinforced ties between the arrays of wires can be employed.

The fencing in FIG. 2 has a saving, as opposed to fencing in which all of the transverse wires extend the full width of the mesh, of about 5% of the wire material.

The wire mesh fencing of FIGS. 1 and 2 can be made on conventional knotted mesh fabricating machines with only minor adjustments thereof.

Figure 3:
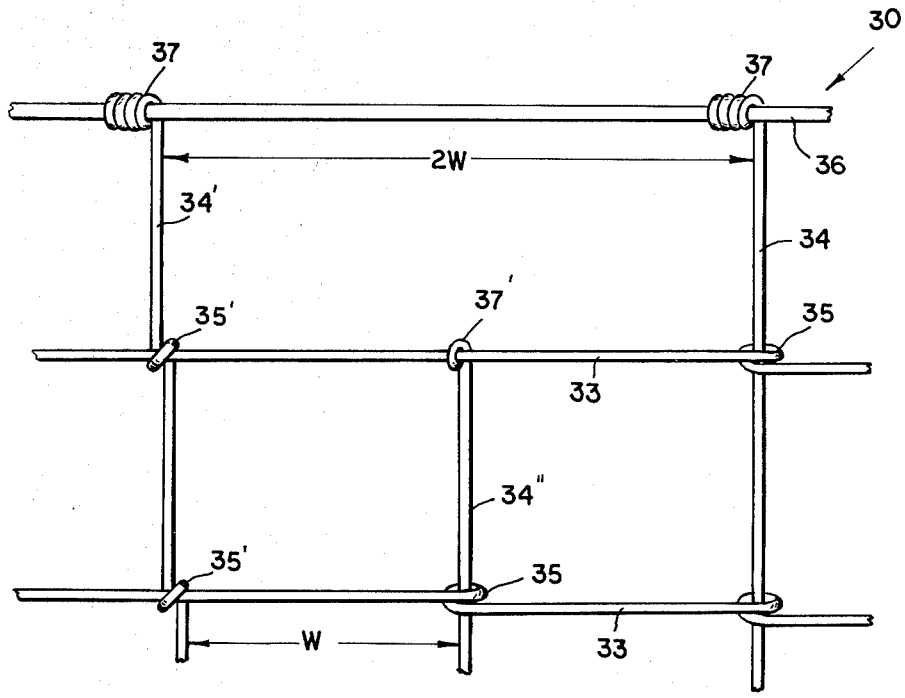
FIG. 3 is a detail view, drawn to an enlarged scale, of a knotted mesh fence of the present invention, only the upper edge of which has been illustrated.

FIG. 3 shows various possibilities for the knotting of the crossover points of the wire mesh of the present invention. For example, the transverse wires 34 and 34' can have bent-over portions 37 engaging the uppermost longitudinal wire 36. Alternatively, this wire 36 can be twisted around the transverse wires as shown for the tiepoints 35 and 35'. Similarly, the foreshortened transverse wire 34'' can be twisted over the next lower longitudinal wire 33 as represented at 37' or the wire 33 can be twisted around the transverse wire 34''.

At the crossover points 35, the longitudinal wires are twisted around the transverse wires 34, 34'' to provide hinge-like junctions allowing the wires 34 and 34'' to twist at least limitedly. The transverse wires 34, 34'' may be provided with slight undulations in the twist regions to prevent relative movement of the transverse wires 33.

At the crossover points 35', however, the transverse wire 34' is twisted around the longitudinal wires 33 with hinge-like junctions and longitudinal wires 33 can be provided with slight undulations in these regions to prevent movement of the transverse wires 34' along the longitudinal wires.

Any combination of the aforedescribed knotting arrangement can be used in accordance with the principles of the present invention.

I claim:

1. Knotted wire mesh, especially for fencing, comprising:

a first array of mutually parallel spaced-apart longitudinal wires with the spacing between two longitudinal wires being H at one edge of said first array, said wires of said first array having a spacing progressively increasing from H from said one edge of said first array to the opposite edge thereof at which the longitudinal wires have a spacing H' which is greater than H; and a second array of single transverse wires reaching from said one edge towards said opposite edge of the mesh and in mutually spaced substantially parallel relation, the two arrays of wires having crossover points at which said transverse wires and said longitudinal wires are tied together by the looping of one of the wires at each crossover point in a single loop about the other wire at such point, the lengths of successive transverse wires along the second array varying periodically by at least the spacing H' at said opposite edge of said mesh, a first transverse wire of said second array extending the full width of said first array between said edges, second, third and fourth transverse wires of said second array counting along the second array from said first wire terminating at longitudinal wires inwardly from said opposite edge of said mesh, said second and fourth transverse wires terminating at a different one of the longitudinal wires than that at which said third wire terminates inwardly from said opposite edges, and said first, second, third and fourth transverse wires repeating periodically along said second array.

* * * * *